US007345242B2

(12) United States Patent
Chen

(10) Patent No.: US 7,345,242 B2
(45) Date of Patent: Mar. 18, 2008

(54) ELECTRICAL COMPOSITE CONDUCTOR AND ELECTRICAL CABLE USING THE SAME

(75) Inventor: Ga-Lane Chen, Santa Clara, CA (US)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/559,840

(22) Filed: Nov. 14, 2006

(65) Prior Publication Data

US 2007/0151744 A1 Jul. 5, 2007

(30) Foreign Application Priority Data

Dec. 30, 2005 (CN) ..... 2005 1 0121415

(51) Int. Cl.
*H01B 3/44* (2006.01)

(52) U.S. Cl. ..... 174/110 R

(58) Field of Classification Search ..... 174/110 R, 174/102 SC

See application file for complete search history.

(56) References Cited

U.S. PATENT DOCUMENTS 6,576,844 B1 * 6/2003 Kamata ..... 174/126.1
7,045,716 B2 5/2006 Granheim
2002/0074932 A1 * 6/2002 Bouchard et al. ..... 313/495
2004/0020681 A1 * 2/2004 Hjortstam et tal. ... 174/102 SC
2006/0061011 A1 * 3/2006 Kikuchi et al. ..... 264/289.3
2006/0155035 A1 * 7/2006 Metzemacher et al. ..... 524/445
2007/0057415 A1 * 3/2007 Katagiri et al. ..... 264/614

* cited by examiner

*Primary Examiner*—Chau Nguyen N.
(74) *Attorney, Agent, or Firm*—Jeffrey T. Knapp

(57) ABSTRACT

A composite conductor includes a metal matrix and a certain amount of carbon nanotubes. The metal matrix is comprised of a material selected from the group consisting of copper, zinc, silver and any combination alloy thereof. A percentage by mass of the carbon nanotubes is in an approximate range from 0.2 percent to 2 percent. An electrical cable (100) includes an interior composite conductor core (10) and an exterior layer (20). The exterior layer further includes an insulating layer (21), a shielding layer (22) and a protective layer (23). The insulating layer is comprised of nanoclay and Teflon. The shielding layer is comprised of carbon nanotubes, carbon nanotube yarn and copper. The protective layer is comprised of nanoclay.

7 Claims, 1 Drawing Sheet

ELECTRICAL COMPOSITE CONDUCTOR AND ELECTRICAL CABLE USING THE SAME

BACKGROUND OF THE INVENTION

1. Field of the Invention

The invention relates generally to conductors and electrical cables, and more particularly to an electrical composite conductor and an electrical cable using carbon nanotubes to enhance electrical conductivity.

2. Description of Related Art

Electrical cables are used as a carrier to transfer electrical power and data signals. An electrical cable includes at least one conductor core and an insulating jacket surrounding the conductor. The conductor core requires good electrical conductivity. The insulating jacket is needed to fulfill certain mechanical and electrical properties, such as fire prevention and protection of the conductor core. Further, the electrical cables can include EMI (electromagnetic interference) shielding layers.

Copper or copper alloys are usually selected as conductor materials in electrical cables. Copper has good electrical conductivity, but suffers from problems like eddy current loss and RF (radio frequency) signal decay due to EMI. Eddy current loss is power loss (usually in the form of heat) in an electrical cable. In addition, heat is generated when current flows through the conductor of the electrical cable. The amount of heat generated is proportional to the resistance of the conductor. The resistance of the conductor is directly proportional to its length and inversely proportional to its cross-sectional area. EMI can be emitted by electrical circuits carrying rapidly changing signals as a by-product of their normal operation and can cause unwanted signals (interference or noise) to be induced in other circuits.

Many electrical cables, such as seismic, oceanographic, and telephone cables are used in corrosive environments at pressures that may range from atmospheric to very high and at temperatures that may range from arctic to very high. Accordingly, the insulating materials used in such cables must be able to withstand these harsh environments, as well as have the insulating and capacitive properties desirable for cables. Polymers, such as PVC, are selected as materials of the electrical cable exterior insulator. However, it is difficult for devices using polymers to meet the European Union's new RoHS (restriction of hazardous substances) standards as polymers may are often highly inflammable and toxic.

What is needed, therefore, is a conductor having better electrical conductivity than copper and an electrical cable using the same that can satisfy RoHS.

SUMMARY OF THE INVENTION

An electrical composite conductor includes a metal matrix and a certain amount of carbon nanotubes. The carbon nanotubes are incorporated into the metal matrix. The metal matrix is comprised of a material selected from the group consisting of copper, zinc, silver and any combination alloy thereof. A percentage by mass of the carbon nanotubes is in the approximate range from 0.2 percent to 2 percent.

An electrical cable includes an interior composite conductor core and an exterior layer. The composite conductor core includes a metal matrix and a certain amount of carbon nanotubes. The carbon nanotubes are incorporated into the metal matrix. The metal matrix is comprised of a material selected from the group consisting of copper, zinc, silver and any combination alloy thereof. An approximate percentage by mass of the carbon nanotubes is in the approximate range from 0.2 percent to 2 percent. A mixture of the metal matrix and carbon nanotubes can be formed using a vacuum melting method, a sintering method and/or a hot pressing method.

The exterior layer further includes an insulating layer, a shielding layer and a protective layer. The insulating layer is comprised of a material selected from a group consisting of nanoclays, Teflon, polymers and any combination thereof. The shielding layer is comprised of a material selected from a group consisting of carbon nanotubes, carbon nanotube yarns, metals and any combination thereof. The protective layer is comprised of a material selected from the group consisting of nanoclay, an epoxy-based nanoclay material, a nitride-based nanoclay material, an ester-based nanoclay material, a urethane-based nanoclay material and any combination thereof.

Advantages and novel features of the present electrical composite conductor and electrical cable will become more apparent from the following detailed description of preferred embodiments when taken in conjunction with the accompanying drawings.

BRIEF DESCRIPTION OF THE DRAWING

The components in the drawing are not necessarily drawn to scale, the emphasis instead being placed upon clearly illustrating the principles of the present invention.

Figure 1:
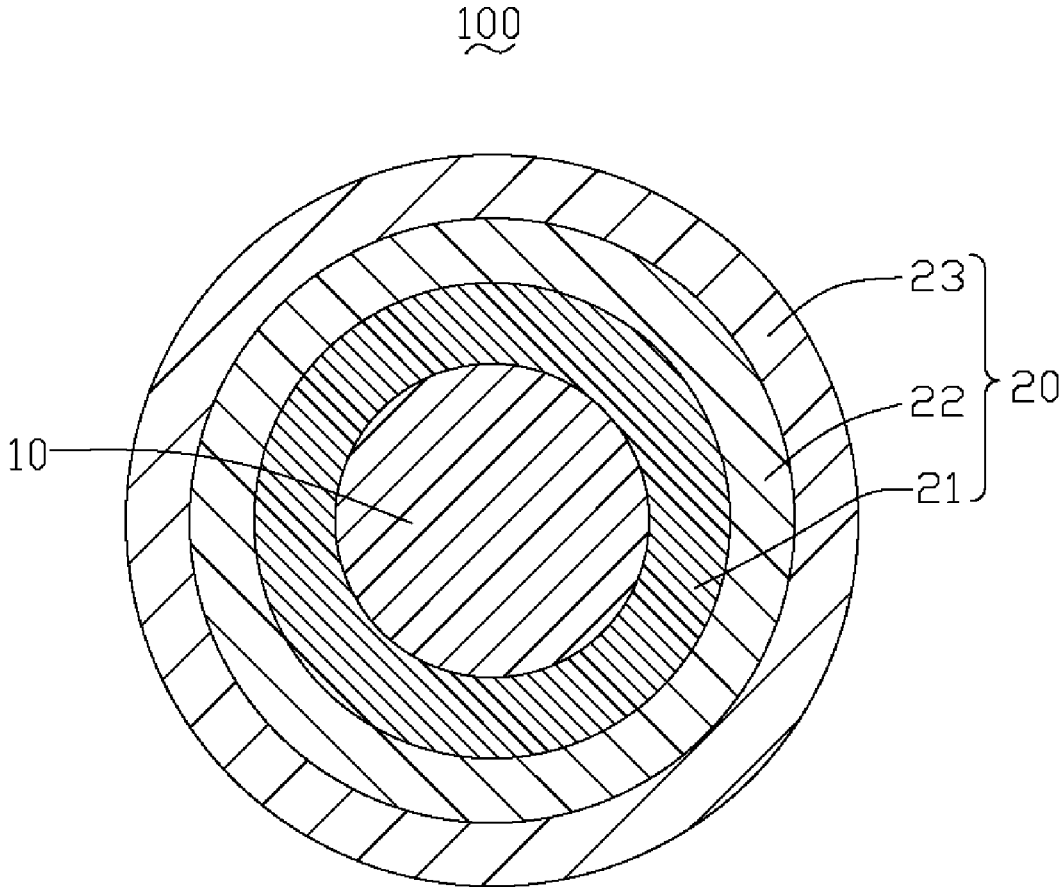
FIG. 1 is an schematic, cross-sectional view of an electrical cable in accordance with a preferred embodiment of the present invention.

Corresponding reference characters indicate corresponding parts. The exemplifications set out herein illustrate at least one preferred embodiment of the present electrical composite conductor and electrical cable, in one form, and such exemplifications are not to be construed as limiting the scope of the invention in any manner.

DETAILED DESCRIPTION OF THE INVENTION

Reference will now be made to the drawings to describe embodiments of the present electrical composite conductor and electrical cable in detail.

In one preferred embodiment, an electrical composite conductor includes a metal matrix and a certain amount of carbon nanotubes. The metal matrix is comprised of a material selected from the group consisting of copper, zinc, silver and any combination alloy thereof. The carbon nanotubes are incorporated in the metal matrix. A percentage by mass of the carbon nanotubes is in the approximate range from 0.2 percent to 2 percent. The electrical composite conductor can be formed by mixing the metal matrix with the carbon nanotubes using vacuum melting, sintering or hot pressing methods.

Referring to FIG. 1, an electrical cable 100 according to a preferred embodiment of the present invention is shown. The electrical cable 100 includes an interior composite conductor core 10 and an exterior layer 20. The composite conductor core 10 includes a metal matrix and a number of nanotubes incorporated in the metal matrix. The metal is selected from a group consisting of copper, zinc, silver and any combination alloy thereof. A percentage by mass of the carbon nanotubes is in the approximate range from 0.2 percent to 2 percent. The interior composite conductor core 10 can be formed by mixing the copper matrix with the carbon nanotubes using vacuum melting, sintering or hot pressing methods.

The exterior layer 20 can include an insulating layer 21, a shielding layer 22 and a protective layer 23. The insulating layer 21, shielding layer 22 and protective layer 23 enclose the interior composite conductor core 10 coaxially in that order. The insulating layer 21 can be comprised of a material selected from the group consisting of nanoclay, Teflon, polymer and any combination thereof. The above nanoclay can be comprised of $(NaCa)(AlMg)_6Si_{12}O_{30}(OH)_6.nH_2O$, wherein n symbolizes nanoclay contains uncertain amount $H_2O$ composition. The nanoclay can be a fire resistant and flame retardant composite material. The polymers can be selected from polyolefin family, such as polyethylene, polypropylene, and polyethylene propylene co-polymer, and fluoropolymer family, such as ethylene tetrafluoroethylene, fluorinated ethylene propylene, polytetrafluoroethylene/perfluoromethylvinylether co-polymer, and perfluoroalkoxy polymer. The insulating layer 21 electrically insulates the conducting core 10 and is disposed between the conducting core 10 and the shielding layer 22.

The shielding layer 22 is comprised of a material selected from a group consisting of carbon nanotubes, carbon nanotube yarns, metals and any combination thereof. A percentage by mass of the carbon nanotubes can be in an approximate range from 50 percent to 100 percent. The shielding layer 22 is used for protecting the cable from EMI (electromagnetic interference) and RFI (radio frequency interference). The shielding layer 22 is disposed between the insulating layer 21 and the protective layer 23.

The protective layer 23 is made from a material selected from the group consisting of nanoclay, epoxy-based nanoclay material, nitride-based nanoclay material, ester-based nanoclay material, urethane-based nanoclay material and any combination compound thereof. Nanoclay material satisfies RoHS requirements and reduces the risk of fire at the same time. Alternatively, the exterior layer 20 need only include the insulating layer 21 and the protective layer 23.

Carbon nanotubes are good electrical conductors and also have excellent mechanical properties with ultra high elastic moduli. The present embodiment uses carbon nanotubes to enhance electrical cable characteristics by mixing copper alloy with carbon nanotubes to form a composite conductor. The present invention can reduce eddy current loss and RF (radio frequency) signal decay in GHz range. The present invention is very good for use in antennae operating at microwave frequencies. The present invention also has better electrical conductivity and lower resistance than conventional electrical cables.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. An electrical cable, comprising:

an interior composite conductor core comprising a metal matrix and a plurality of carbon nanotubes incorporated in the metal matrix; and an exterior layer enclosing the interior composite conductor core therein, the exterior layer being configured for electrically insulating the interior composite conductor core, wherein the exterior layer comprises an insulating layer, and the insulating layer comprises a nanoclay being comprised of $(NaCa)(AlMg)_6Si_{12}O_{30}(OH)_6 \cdot nH_2O$.

2. The electrical cable as claimed in claim 1, wherein the metal matrix is comprised of a material selected from the group consisting of copper, zinc, silver and any combination alloy thereof.

3. The electrical cable as claimed in claim 1, wherein a percentage by mass of the carbon nanotubes is in the approximate range from 0.2 percent to 2 percent.

4. The electrical cable as claimed in claim 1, wherein the exterior layer comprises a shielding layer and a protective layer, and the insulating layer, the shielding layer, and the protective layer enclose the interior composite conductor core coaxially, in that order.

5. The electrical cable as claimed in claim 4, wherein the shielding layer is comprised of a material selected from the group consisting of carbon nanotubes, carbon nanotube yarn, metal and any combination thereof.

6. The electrical cable as claimed in claim 5, wherein a percentage by mass of the carbon nanotubes in the shielding layer is in an an approximate range from 50 percent to 100 percent.

7. The electrical cable as claimed in claim 4, wherein the protective layer is comprised of a material selected from the group consisting of nanoclay, an epoxy-based nanoclay material, a nitride-based nanoclay material, an ester-based nanoclay material, a urethane-based nanoclay material and any combination thereof.

* * * * *